US010888927B2

(12) United States Patent
Bochiechio et al.

(10) Patent No.: US 10,888,927 B2
(45) Date of Patent: Jan. 12, 2021

(54) METHOD OF MANUFACTURING A HYBRID CYLINDRICAL STRUCTURE

(71) Applicant: United Technologies Corporation, Farmington, CT (US)

(72) Inventors: Mario P. Bochiechio, Vernon, CT (US); Darryl Slade Stolz, Newington, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 0 days.

(21) Appl. No.: 16/518,171

(22) Filed: Jul. 22, 2019

(65) Prior Publication Data

US 2019/0337057 A1 Nov. 7, 2019

Related U.S. Application Data

(63) Continuation of application No. 15/035,867, filed as application No. PCT/US2014/064008 on Nov. 5, 2014, now Pat. No. 10,471,511.

(Continued)

(51) Int. Cl.

| | |
|---|---|
| ***B22F 7/02*** | (2006.01) |
| ***B22F 3/06*** | (2006.01) |
| ***B22F 7/06*** | (2006.01) |
| ***B22F 5/10*** | (2006.01) |
| ***B22F 3/08*** | (2006.01) |

(Continued)

(52) U.S. Cl.

CPC ..... *B22F 7/02* (2013.01); *B22F 3/06* (2013.01); *B22F 3/08* (2013.01); *B22F 3/093* (2013.01); *B22F 5/106* (2013.01); *B22F 7/06* (2013.01); *B22F 3/15* (2013.01); *B22F 3/17* (2013.01); *B22F 3/24* (2013.01); *B22F 5/009* (2013.01);

(Continued)

(58) Field of Classification Search

CPC .... B22F 3/06; B22F 7/02; B22F 5/106; B22F 7/06; B22F 3/093; B22F 3/08; B22F 5/009; B22F 2998/10; B22F 2999/00; B22F 3/1208; B22F 2202/01; B22F 2003/247; B22F 2003/208; B22F 3/17; B22F 3/24; B22F 3/15

See application file for complete search history.

(56) References Cited

U.S. PATENT DOCUMENTS 2,390,160 A 12/1945 Marvin
2,541,531 A 2/1951 Morris et al.

(Continued)

FOREIGN PATENT DOCUMENTS

GB 2264719 A 9/1993
JP H04173948 * 6/1992 ..... B22F 1/00

(Continued)

OTHER PUBLICATIONS

Machine Translation of JP 07-005937 to Mitsubishi Metal Corp (Year: 1995).*

(Continued)

*Primary Examiner* — Daniel C. Mccracken
(74) *Attorney, Agent, or Firm* — Carlson, Gaskey & Olds, P.C.

(57) ABSTRACT

A method of manufacturing a multi-material tubular structure includes spinning a can, depositing a powdered material into the can and compacting the powdered material within the can to provide a tubular structure.

19 Claims, 3 Drawing Sheets

Related U.S. Application Data

(60) Provisional application No. 61/908,642, filed on Nov. 25, 2013.

(51) Int. Cl.

| | |
|---|---|
| ***B22F 3/093*** | (2006.01) |
| ***B22F 3/15*** | (2006.01) |
| ***B22F 3/17*** | (2006.01) |
| ***B22F 3/24*** | (2006.01) |
| ***B22F 5/00*** | (2006.01) |

(52) U.S. Cl.
CPC ..... *B22F 2998/10* (2013.01); *B22F 2999/00* (2013.01)

(56) References Cited

U.S. PATENT DOCUMENTS

| | | | | |
|---|---|---|---|---|
| 3,697,261 | A | | 10/1972 | Jump et al. |
| 4,486,385 | A | * | 12/1984 | Aslund ..... B22F 3/20 419/41 |
| 4,632,168 | A | | 12/1986 | Noble |
| 4,851,190 | A | | 7/1989 | Bowen et al. |
| 5,132,143 | A | | 7/1992 | Deckard |
| 5,280,052 | A | | 1/1994 | Questel et al. |
| 5,387,380 | A | | 2/1995 | Cima et al. |
| 6,623,690 | B1 | | 9/2003 | Rizzo et al. |
| 7,361,203 | B2 | | 4/2008 | Shimizu et al. |
| 7,833,472 | B2 | | 11/2010 | Ott et al. |
| 2010/0247944 | A1 | | 9/2010 | Mleczko et al. |
| 2013/0028781 | A1 | | 1/2013 | Xu |

FOREIGN PATENT DOCUMENTS

| | | | | |
|---|---|---|---|---|
| JP | H06136409 | | 5/1994 | |
| JP | H0647713 | | 6/1994 | |
| JP | 07-005937 | * | 1/1995 | ..... B22F 9/08 |
| JP | H07-005937 | | 1/1995 | |
| KR | 1020090068720 | A | 6/2009 | |

OTHER PUBLICATIONS

Machine Translation of JPH04173948 to Hosokawa Mikron KK, et al. (Year: 1992).*
European Office Action for European Application No. 14863376.1 dated Jun. 24, 2019.
International Search Report and Written Opinion for PCT/US2014/064008 dated Mar. 11, 2015.
International Preliminary Report on Patentability for International Application No. PCT/US2014/064008 dated Jun. 9, 2016.
Supplementary European Search Report for European Application No. 14863376.1 dated Jul. 17, 2017.

* cited by examiner

METHOD OF MANUFACTURING A HYBRID CYLINDRICAL STRUCTURE

CROSS-REFERENCE TO RELATED APPLICATIONS

This application is a continuation of Untied States application Ser. No. 15/035,867 filed May 11, 2016, which is a National Stage Entry of PCT Application No. PCT/US2014/064008 filed on Nov. 5, 2014, which claims priority to U.S. Provisional Application No. 61/908,642, which was filed on Nov. 25, 2013 and is incorporated herein by reference.

BACKGROUND

This disclosure relates to a method for manufacturing a hybrid structure. The method may be used for manufacturing gas turbine engine turbine and compressor disks, seals, cover plates, minidisks, integrally bladed rotors, compressor aft hub, shafts, for example.

A gas turbine engine uses a compressor section that compresses air. The compressed air is provided to a combustor section where the compressed air and fuel is mixed and burned. The hot combustion gases pass over a turbine section to provide work that may be used for thrust or driving another system component.

Gas turbine engines use tubular structures, such as disks, or rotor, that support a circumferential array of blades. It may be desirable to use multiple materials to optimize mechanical and/or fatigue properties, such as yield strength or creep strength, at particular locations in the disk. In one example, disk portions of different materials are bonded or welded to one another to provide the desired strength. Post machining may be required to clean up the weld or bond interface. As a result, the transition point between the materials must be selected such the transition point is in a location that is accessible for machining.

SUMMARY

In one exemplary embodiment, a method of manufacturing a multi-material tubular structure includes spinning a can, depositing a powdered material into the can and compacting the powdered material within the can to provide a tubular structure.

In a further embodiment of the above, the can is spun to forces of greater than 1 G.

In a further embodiment of any of the above, the can is cylindrical in shape.

In a further embodiment of any of the above, the depositing step includes the can and a powder injector moving relative to one another during powder deposition.

In a further embodiment of any of the above, the powdered material is an atomized metal.

In a further embodiment of any of the above, the compacting step includes vibrating the can during spinning step.

In a further embodiment of any of the above, the can is mechanically vibrated.

In a further embodiment of any of the above, the can is acoustically vibrated.

In a further embodiment of any of the above, the method includes the step of scraping a layer of powdered material in the can to provide a desired wall thickness.

In a further embodiment of any of the above, the method includes the step of inspecting the characteristics of the layer.

In a further embodiment of any of the above, the method includes the step of depositing a powdered metal into an inner cavity of the tubular structure to form a cylindrical structure having a solid cross-section.

In a further embodiment of any of the above, the method includes the step of consolidating the tubular structure to provide a billet.

In a further embodiment of any of the above, the method includes the step of cutting a compacted billet to a desired length.

In a further embodiment of any of the above, the method includes the step of forging the billet.

In a further embodiment of any of the above, the method includes the step of depositing multiple layers of powdered material.

In a further embodiment of any of the above, the multiple layers include a different material than one another.

In a further embodiment of any of the above, the method includes the step of packing a first layer before depositing a second layer.

In a further embodiment of any of the above, the method includes the step of providing an inner form within the can.

In a further embodiment of any of the above, the method includes the step of providing a vacuum on the inner form.

In a further embodiment of any of the above, the method includes the step of heating the powdered material.

BRIEF DESCRIPTION OF THE DRAWINGS

The disclosure can be further understood by reference to the following detailed description when considered in connection with the accompanying drawings wherein.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

DETAILED DESCRIPTION

The disclosed manufacturing method provides a hybrid, or multi-alloy, powdered metal tubular structure, or disk that may be used in gas turbine engine applications.

Figure 1:
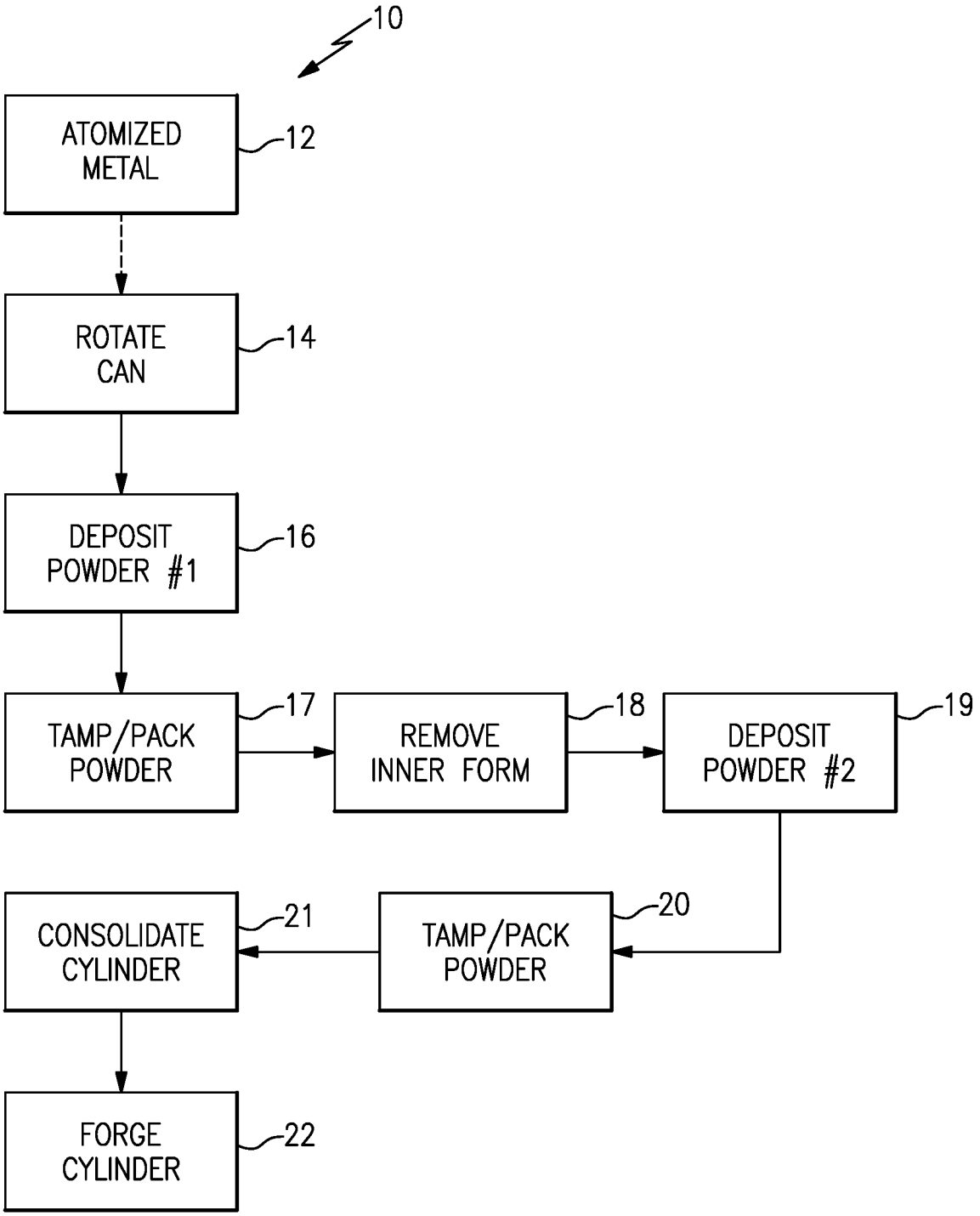
FIG. 1 is a flow chart depicting an example method of manufacturing a hybrid cylindrical structure.

The method of manufacturing the powdered metal disk is shown schematically at 10 in FIG. 1. An atomized metal 12, as indicated at block 12, is provided to the tube forming machine as a powdered metal. A can is rotated (block 14) and the powdered metal is deposited into the can (block 16). The powdered metal is deposited into one or more layers and tamped or packed while in the can, as indicated at block 17, to maximize the packing density of the powdered material. If an inner form is used, it is removed, as indicated at block 18.

Another powdered metal is deposited into the tubular shape of the first, packed structure, as indicated at block 19, and tamped or packed, as indicated at block 20, to create a multi-material cylindrical structure. The cylindrical structure is consolidated, as indicated at block 21, to greatly increase the density of the cylinder. Example consolidation techniques include, for example, extrusion, hot compaction, hot-isostatic compaction, and high explosive consolidation. The consolidated cylindrical structure can be forged to provide a disk or other structure as indicated at block 22.

Figure 2A:
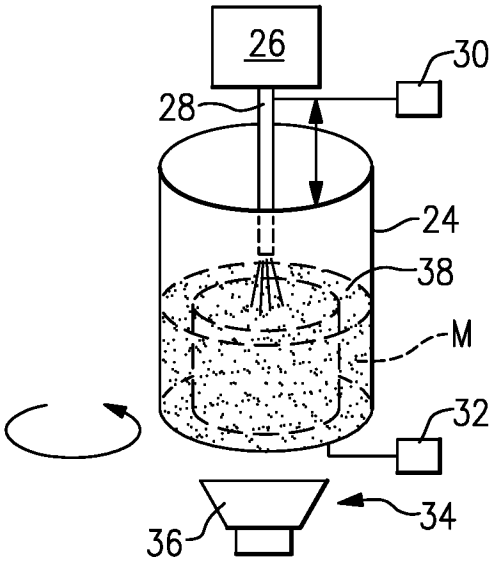
FIG. 2A schematically illustrates depositing powdered metal into a rotating can to provide a layer of material.

An example tube forming machine is shown schematically in FIG. 2A. The machine includes a can 24, which is cylindrical in one example that is rotated by a drive 32. A powder supply 26 provides powdered metal to a powder injector 28, which deposits the material M into the can 24 as it rotates. In one example, the can 24 rotates at a velocity sufficient to induce forces of greater than 1 G, which flings the powdered metal outward and into engagement with the wall of can 24. The material M adheres to the wall of the can 24.

The powder injector 28 is moved axially by an actuator 30 as the can 24 fills with the material M. One or more passes by the powder injector 28 may be used to create a layer of a particular material.

The vibrator 34 vibrates the can 24 as it rotates to compact the powdered material, for example, to 60-74 percent of the maximum theoretical density of the material. The material M may be heated during deposition, if desired. The vibrator 34 may be a mechanical device that physically engages the can 24 or an acoustic device 36, which acoustically compacts the material M from a predetermined distance.

Figure 2B:
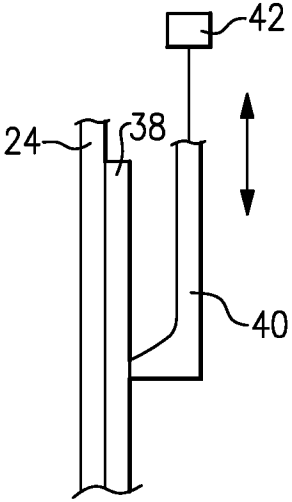
FIG. 2B schematically depicts scraping the layer to provide a desired thickness.

A first layer of material 38 is deposited into the can at 24, as shown in FIG. 2B. To ensure a desired thickness, a scraper, 40, may be utilized to cooperate with a surface of the first layer 34. The scraper 40 is moved axially by an actuator 42 along the layer to provide a desired surface contour.

Figure 2C:
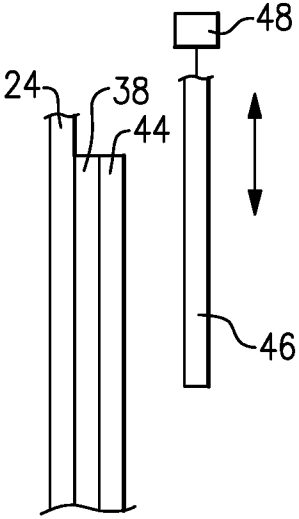
FIG. 2C schematically depicts probing the layer.

Referring to FIG. 2C, a second layer 44 may be deposited onto the first layer 38, if desired. In this example, a different material is provided to the powder injector 28. More than two layers may also be used. A probe 46 driven by an actuator 48 is used to inspect the thickness and/or surface characteristics of the layers to ensure desired parameters, such as thickness and surface finish, are achieved during powder metal deposition. In one example, the probe is an optical sensor.

Figure 2D:
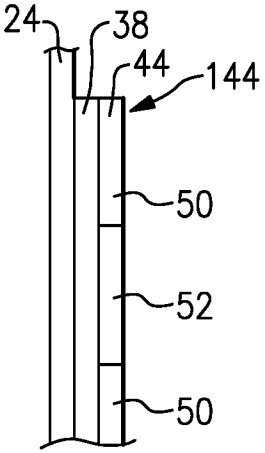
FIG. 2D schematically depicts multiple layers constructed from multiple materials.

One or more of the layers may be provided by multiple layer portions, for example. In one example, first and second layer portions 50, 52 are provided in the layer 144, as shown in FIG. 2D. The inner diameter or cavity formed by the tubular layer or layers is filled with a powdered metal to form a cylindrical structure having a solid cross-section. This material is compacted as well. Alternatively, the inner cavity may be left void to provide a tubular structure. Thus, different materials may be provided in different desired locations along the tubular structure to tune the mechanical characteristics of the disk. Deposition of different materials may be provided in a manner other than shown in the Figures.

Figure 2E:
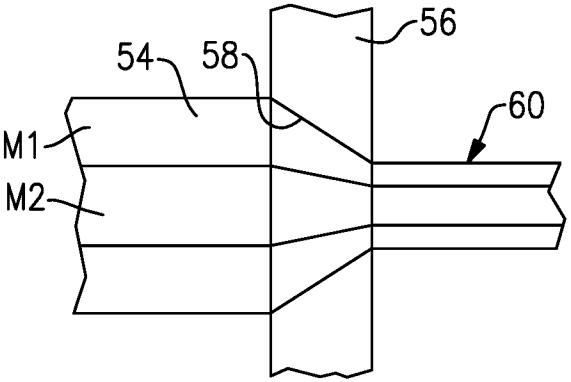
FIG. 2E schematically depicts extruding the cylindrical structure.
Figure 2F:
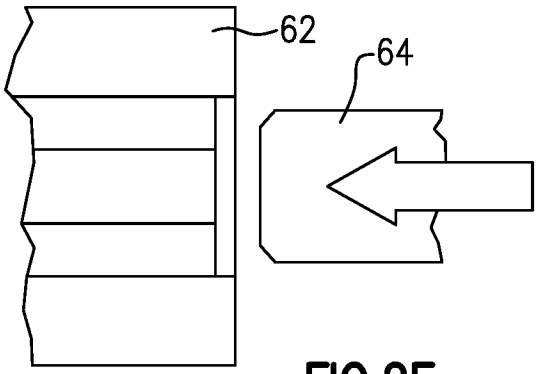
FIG. 2F schematically depicts forging an extrusion.

The compacted powder cylindrical structure 54 is consolidated, for example, by extruding through a profile 58 of a die 56, as shown in FIG. 2E, to increase the density to 99 percent or greater than the theoretical maximum density and provide a cylindrical billet. The extrusion may be done while heating the powdered material to, for example, 2000° F. (1093° C.). The extrusion 60 may be cut to length for easier handling. The extrusion 60 may be forged between first and second die portions 62, 64 to a near-net shape, for example, of a compressor or turbine disk, as shown in FIG. 2F.

Figure 3A:
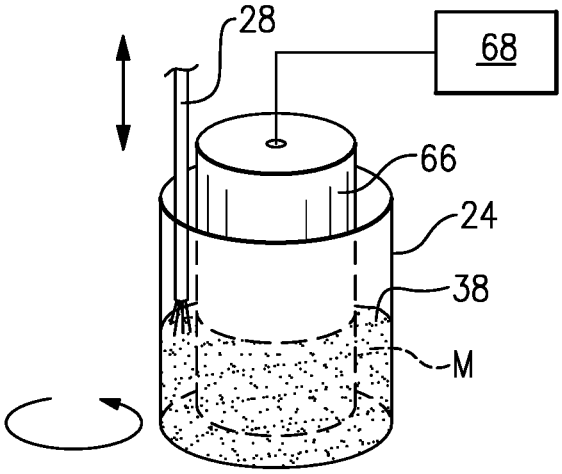
FIG. 3A schematically depicts depositing a powdered metal into a can with an inner form.

Another manufacturing technique is illustrated in FIG. 3A in which an inner form 66 is provided within the can 24 to provide a more precise inner wall of the powder tube. The inner form 66 is arranged within the can 24 as it rotates, and powdered material is deposited by the powder injector 28. In one example, a vacuum source 68 is in communication with the inner form 66 to draw the powdered material toward the inner form 66 during material deposition. If multiple layers of powder are desired, the inner form 66 may be removed and a smaller diameter inner form may be inserted into the can 24, for example.

Figure 3B:
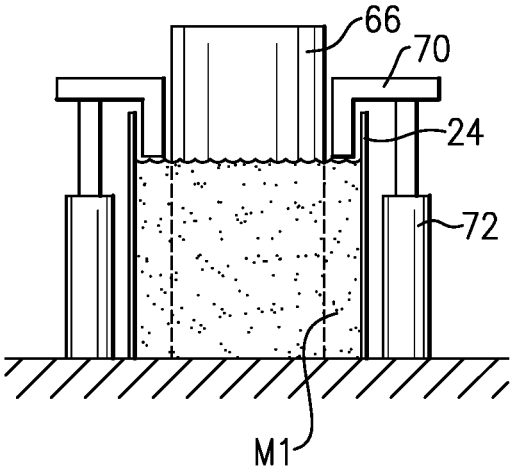
FIG. 3B schematically depicts packing the can with the inner form.

Referring to FIG. 3B, the tamping member 70, which may include an annular flange is arranged to compact the material or the layer 38 provided between the inner form and the can 24. The tamping member 70 is actuated by pneumatic or hydraulic cylinders 72, for example. The powder tube may be scraped, probed, extruded and forged, as described above, if desired.

It should also be understood that although a particular component arrangement is disclosed in the illustrated embodiment, other arrangements will benefit herefrom. Although particular step sequences are shown, described, and claimed, it should be understood that steps may be performed in any order, separated or combined unless otherwise indicated and will still benefit from the present invention.

Although the different examples have specific components shown in the illustrations, embodiments of this invention are not limited to those particular combinations. It is possible to use some of the components or features from one of the examples in combination with features or components from another one of the examples.

Although an example embodiment has been disclosed, a worker of ordinary skill in this art would recognize that certain modifications would come within the scope of the claims. For that reason, the following claims should be studied to determine their true scope and content.

What is claimed is:

1. A method of manufacturing a multi-material tubular structure comprising:

spinning a can to forces of greater than 1G;

depositing a powdered material into the can during the spinning step with a powder injector moving relative to the can during powder deposition, wherein the depositing step includes moving the powder injector axially with an actuator as the can fills with the powdered material; and compacting the powdered material within the can to provide a tubular structure.

2. The method according to claim 1, wherein the can is cylindrical in shape.

3. The method according to claim 1, wherein the powdered material is an atomized metal.

4. The method according to claim 1, wherein the compacting step includes vibrating the can during spinning step.

5. The method according to claim 4, wherein the can is mechanically vibrated.

6. The method according to claim 4, wherein the can is acoustically vibrated.

7. The method according to claim 1, wherein an end of the powdered injector is arranged within the can during the depositing step.

8. The method according to claim 1, comprising inspecting the characteristics of the layer.

9. The method according to claim 1, comprising the step of depositing a powdered metal into an inner cavity of the tubular structure to form a cylindrical structure having a solid cross-section.

10. The method according to claim 9, comprising the step of compacting the tubular structure to provide a billet.

11. The method according to claim 10, comprising the step of cutting a compacted billet to a desired length.

12. The method according to claim 10, comprising the step of forging the billet.

13. The method according to claim 1, comprising the step of depositing multiple layers of powdered material.

14. The method according to claim 13, wherein the multiple layers include a different material than one another.

15. The method according to claim 1, comprising the step of packing a first layer before depositing a second layer.

16. The method according to claim 1, comprising the step of providing an inner form within the can.

17. The method according to claim 1, comprising the step of heating the powdered material.

18. A method of manufacturing a multi-material tubular structure comprising:

spinning a can;

depositing a powdered material into the can during the spinning step with a powder injector moving relative to the can during powder deposition, wherein the depositing step includes moving the powder injector axially with an actuator as the can fills with the powdered material; and compacting the powdered material within the can to provide a tubular structure.

19. A method of manufacturing a multi-material tubular structure comprising:

spinning a can;

depositing a powdered material into the can, wherein the depositing step includes moving the powder injector axially with an actuator as the can fills with the powdered material; and compacting the powdered material within the can to provide a tubular structure, comprising the step of scraping a layer of powdered material in the can to provide a desired wall thickness.

* * * * *